United States Patent [19]

Yoshidome et al.

[11] Patent Number: 4,766,858

[45] Date of Patent: Aug. 30, 1988

[54] INTERNAL COMBUSTION ENGINE

[75] Inventors: Toshio Yoshidome; Takanori Nagai; Tadayoshi Kono; Mikio Goto, all of Toyota, Japan

[73] Assignee: Toyota Jidosha Kabushiki Kaisha, Japan

[21] Appl. No.: 842,483

[22] Filed: Mar. 21, 1986

[30] Foreign Application Priority Data

Mar. 25, 1985 [JP] Japan ..... 60-42858

[51] Int. Cl.[4] ..... F01M 1/06

[52] U.S. Cl. ..... 123/195 R; 74/572

[58] Field of Search ..... 123/195 R; 74/572; 184/6.18; 384/288, 401, 407, 147, 148

[56] References Cited

U.S. PATENT DOCUMENTS

| | | | |
|---|---|---|---|
| 2,796,769 | 6/1957 | Gratzmuller | 123/195 R |
| 4,346,624 | 8/1982 | Nagasaki et al. | 74/572 |
| 4,370,951 | 2/1983 | Pomfret | 123/195 R |

FOREIGN PATENT DOCUMENTS 168713 1/1980 Japan .

*Primary Examiner*—Craig R. Feinberg
*Assistant Examiner*—David A. Okonsky
*Attorney, Agent, or Firm*—Parkhurst & Oliff

[57] ABSTRACT

This invention relates to an internal combustion engine including an oil seal ring between a cylinder block and a crank shaft, a crank shaft cap and a conduit. The cylinder block includes a plurality of cylinders, a crank shaft support portion and an oil seal retainer. The crank shaft support portion is located under the plurality of cylinders and the oil seal retainer projects outwardly from the cylinder block. A crank case is defined within the cylinder block. The crank shaft cap is secured to the crank shaft support portion and an opening is defined therebetween. The crank shaft includes a main journal and a flange portion. The main journal is inserted into the opening defined between the crank shaft support portion and the crank shaft cap. The crank shaft is rotatably mounted on both the cylinder block and the crank shaft cap. The flange portion extends outwardly from the main journal and is spaced from the crank shaft support portion and the oil seal retainer of the cylinder block, so that a cavity is defined between the flange portion of the crank shaft, the oil seal retainer, the crank shaft support portion of the cylinder block and the crank shaft cap. The oil seal ring is located between the oil seal retainer of the cylinder block and the outer peripheral surface of the flange portion. The conduit is defined within the crank shaft support portion or the crank shaft cap. The conduit communicates the cavity with the crank case.

12 Claims, 5 Drawing Sheets

INTERNAL COMBUSTION ENGINE

BACKGROUND OF THE INVENTION

The present invention relates to an internal combustion engine for a vehicle which has a cylinder block, a crank shaft and a plurality of pistons.

More particularly, the present invention relates to improvements in a sealing means between the cylinder block and the crank shaft in the internal combustion engine.

A conventional sealing means, located between a crank shaft and an oil seal case, is disclosed in Japanese Utility Model Laid Open No. Showa 55-168713. The oil seal case is secured to both a cylinder block and a crank shaft cap. The crank shaft includes a main journal and a flange shaft. The main journal is surrounded by a front main bearing insert and the flange shaft projects forwardly from the main journal. An outer diameter of the flange shaft of the crank shaft is larger than an outer diameter of the main journal and the flange shaft has the same shaft axis as the main journal. A peripheral portion of the flange shaft of the crank shaft is positioned forwardly and apart from both the cylinder block and the crank shaft cap. Therefore, even when the crank shaft receives a thrust load, the peripheral portion of the flange shaft does not contact the cylinder block or the crank shaft cap.

The oil seal case is secured to both the cylinder block and the crank shaft cap. The oil seal case has a larger inner diameter than the outer diameter of the flange shaft. An outer peripheral surface of the flange shaft is spaced from an inner surface of the oil seal case.

The seal means has a "C" cross-sectional shape and inner and outer portions of the seal means contact the outer peripheral surface of the flange shaft and the inner surface of the oil seal case, respectively. The opening of the "C" is directed to the rearward direction of the internal combustion engine. Lubricating oil lubricates the front main bearing insert, the main journal, the crank shaft and the crank shaft cap.

Accordingly, a front end cavity is defined by the flange shaft, the seal means, the oil seal case, the crank shaft cap, the cylinder block and the main journal.

Therefore, even if the lubricating oil leaks into the front end cavity, the seal means prevents the lubricating oil from leaking out from the cylinder block.

During the compression strokes and expansion strokes of the internal combustion engine, blow-by gas leaks from between contacting portions of a cylinder wall of a cylinder block and piston rings which are secured to a piston. Normally the blow-by gas includes a large amount of water. Because the front end cavity is almost sealed by the flange shaft, the seal means, the oil seal case, the crank shaft cap, the cylinder block and the main journal, the blow-by gas which leaks into the front end cavity stays within the front end cavity. As a result, the outer peripheral surface of the flange shaft rusts from the water included in the blow-by gas. The rust on the outer peripheral surface detracts from the sealing effect between the seal means and the flange shaft.

In a similar manner, blow-by gas stays in a rear end cavity and an outer peripheral surface of a flange shaft rusts from the water in the blow-by gas.

SUMMARY OF THE INVENTION

The present invention was developed in view of the foregoing background and to overcome the foregoing drawbacks. It is accordingly an object of this invention to provide an internal combustion engine which comprises an cylinder block, a cap member, a crank shaft, a seal means and a connecting passage.

The cylinder block includes a plurality of cylinders, a crank shaft support portion and an oil seal retainer. The crank shaft support portion is located under the plurality of cylinders and the oil seal retainer projects outwardly from the cylinder block. A crank case is defined within the cylinder block. The cap member is secured to the crank shaft support portion of the cylinder block, and an opening is defined therebetween.

The crank shaft includes a journal and a flange portion. The journal is inserted into the opening defined between the crank shaft support portion of the cylinder block and the cap member, so that the crank shaft is rotatably mounted on both the cylinder block and the cap member. The flange portion extends outwardly from the journal, and has an outer peripheral surface thereon. Further, the flange portion is apart from the crank shaft support portion and the oil seal retainer of the cylinder block, so that a space or cavity is defined between the flange portion of the crank shaft, the oil seal retainer and the crank shaft support position of the cylinder block.

The seal means is located between the oil seal retainer of the cylinder block and the outer peripheral surface of the flange portion.

The connecting passage is in one embodiment defined within the crank shaft support portion and the connecting passage connects the cavity to the crank case, whereby the cavity communicates with the crank case through the connecting passage.

Accordingly, blow-by gas does not stay within the cavity and, as a result, the outer peripheral surface of the flange shaft does not rust from water included in the blow-by gas.

Therefore, there is no detraction in the sealing effect between the seal means and the flange shaft.

BRIEF DESCRIPTION OF THE DRAWINGS

The above objects, features and advantages of the present invention will become more apparent from the description of the invention which follows, taken in conjunction with the accompanying drawings, wherein like reference numerals denote like elements.

DETAILED DESCRIPTION OF THE PREFERRED EMBODIMENTS

The present invention will be described in detail with reference to the accompanying drawings which illustrate different embodiments according to the present invention.

Figure 1:
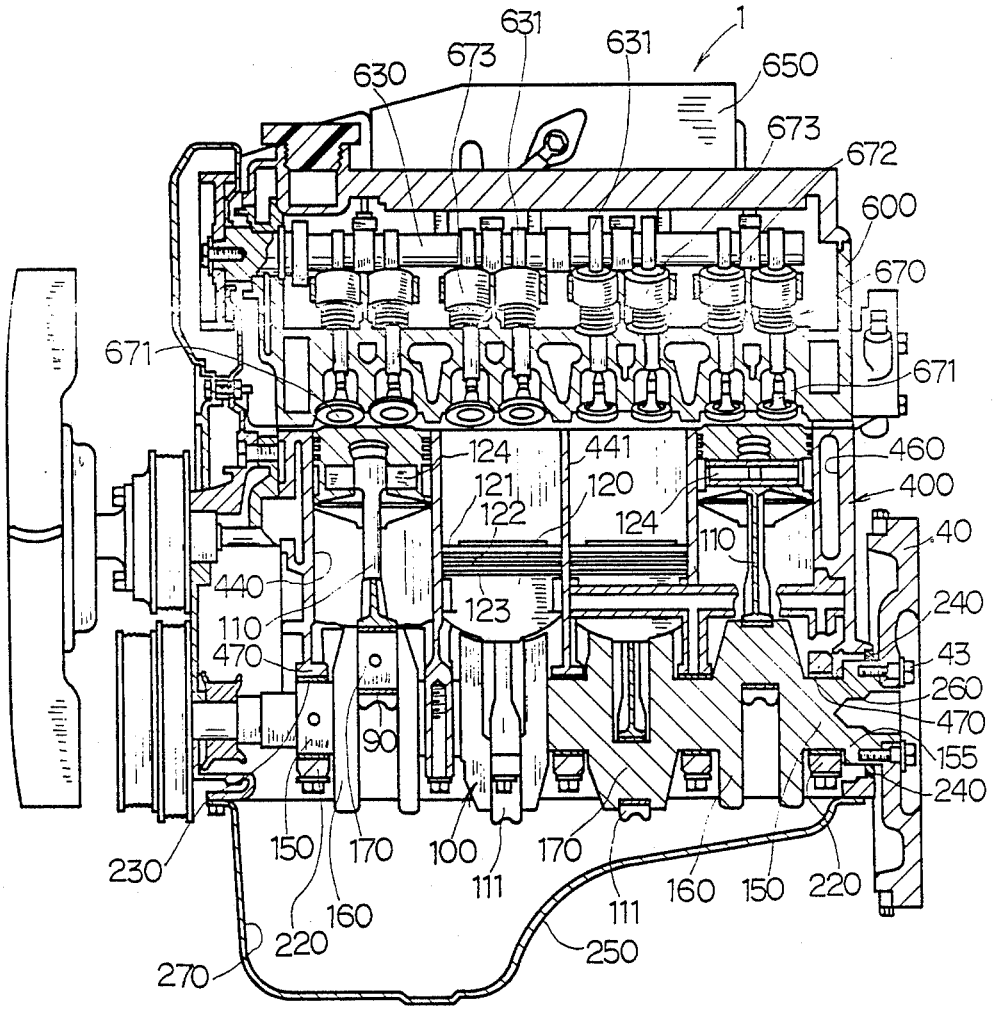
FIG. 1 is a general perspective view, including a plurality of partial cross-sectional views, of an internal combustion engine according to the present invention.

Referring to FIG. 1, an internal combustion engine 1 includes a cylinder head cover 650, a cylinder head 600, a camshaft 630, a plurality of valves 670, a cylinder block 400, a crank shaft 100, a plurality of pistons 120, a crank shaft cap 220, a rear oil seal ring 240 and a fly wheel 40.

The cylinder head cover 650 is mounted on the cylinder head 600. The camshaft 630 is rotatably mounted on the cylinder head 600 and the camshaft 630 includes a plurality of cams 631 thereon. Each of the plurality of cams 631 contacts one of a plurality of shielding caps 673 of the valves 670. Each of the valves 670 is supported on the cylinder head 600 by a corresponding valve spring 672, so that the valve spring 672 biases the shielding cap 673 to contact the cam 631. Further the shielding cap 673 is connected to valve head 671 and the valve spring 672 biases the valve head 671 to close either an inlet channel or an outlet channel, so that when the cam 631 forces the shielding cap 673 downwardly against the bias force of the valve spring 672, the valve head 671 opens either the inlet channel or the outlet channel.

The inlet and outlet channels are formed within the cylinder head 600 and openings of the inlet and outlet channels and the plurality of valve heads 671 face the cylinder 440.

A plurality of cylinders 440 are defined within the cylinder block 400 and each of the plurality of cylinders 440 is separated by a cylinder wall 441. A cooling-water duct 460 is also defined within the cylinder block 400.

The crank shaft 100 is rotatably mounted on the cylinder block 400 under the plurality of cylinders 440. Each of the plurality of pistons 120 is slidably mounted within a corresponding cylinder 440, and a plurality piston rings (i.e., a compression ring 121, a taper ring 122 and an oil ring 123) are secured to each cylinder 440. The plurality of piston rings 121, 122 and 123 contact the cylinder wall 441 during upward and downward movements of the piston 120.

The plurality piston rings 121, 122 and 123 are designed to fit with the cylinder wall 441. However, blow-by gas leaks slightly from between contacting portions of the plurality of piston rings 121, 122 and 123 and the cylinder wall 441 during the compression strokes and expansion strokes of the internal combustion engine. The blow-by gas floats within a crank case 270 defined between the cylinder block 400 and an oil pan 250.

The piston 120 is connected to a small end of a connecting rod 110 by a piston pin 124. A big end of the connecting rod 110 is rotatably mounted by a big end cap 111 on one of a plurality of crank pins 170 of the crank shaft 100.

The crank shaft 100 includes the plurality of crank pins 170, a plurality of main journals 150, a plurality of counter weights 160 and a pair of flange shafts 155. The pair of flange shafts 155 are located at both ends of the crank shaft 100. The crank shaft 100 is rotatably mounted on the cylinder block 400 through the plurality of main journals 150, and shaft centers of the main journals 150 cross a plurality of center points of cylinder 440. Each of the main journals 150 is located under each of a plurality of cylinder walls 441 of the cylinders 440. Each of the two counter weights 160 is located within the cylinders 440 and each of the counter weights 160 is connected to one of the main journals 150. Except for a front main journal 150 and a rear main journal 150, both ends of each main journal 150 are connected to counter weights 160. Each of the crank pins 170 is located between two counter weights 160 which are positioned within one of the cylinders 440, and shaft centers of the crank pins 170 are located apart from the shaft center of the main journals 150. Accordingly, when the crank shaft 100 is rotated about the shaft center of the main journals 150, the crank pins 170 are rotated about the shaft center of the main journals 150. When one of the crank pins 170 is positioned at an uppermost position, the piston 120, which is connected to one of the crank pins 170 through the connecting rod 110, is positioned at a top dead center, and when one of the crank pins 170 is positioned at a lowermost position, the piston 120 is positioned at a bottom dead center.

A plurality of main bearing inserts 230 are located between the main journals 150 and a plurality of crank shaft support portions 470 of the cylinder block 400 or the crank shaft caps 220. A big end bearing insert 90 is located between the crank pin 170 and the big end cap 111 of the connecting rod 110. The fly wheel 40 is secured to the rear flange shaft 155 by bolts 43.

Figure 2:
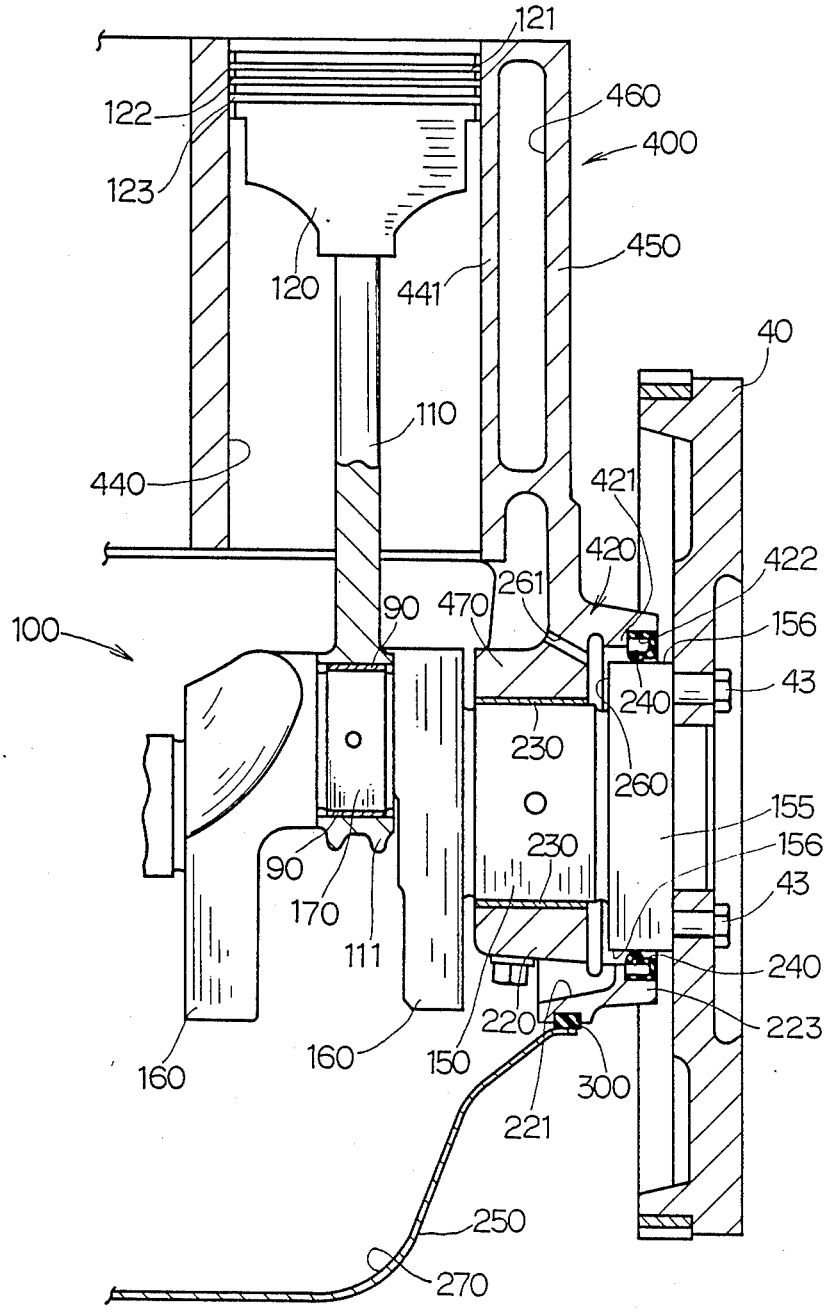
FIG. 2 is an enlarged cross-sectional view of a rear seal ring of the internal combustion engine according to the present invention.

As shown in FIG. 2, the oil pan 250 is located under the cylinder block 400 and a gasket 300 is located between the oil pan 250 and an oil seal retainer 223 adjacent a rearmost crank shaft cap 220 which is secured to a rearmost crank shaft support portion 470. An oil seal retainer 420 projects rearwardly from the rearmost crank shaft support portion 470, and the oil seal retainer 420 includes an annular projection 421 and a step portion 422. The annular projection 421 extends downwardly from the oil seal retainer 420 and the step portion 422 is defined at a rearmost end of the oil seal retainer 420.

A rear flange shaft 155 is connected to and extends rearwardly from the rearmost main journal 150. The rear flange shaft 155 has a larger outer diameter than an outer diameter of the rearmost main journal 150. When the crank shaft 100 is connected to the cylinder block 400 by the crank shaft cap 220, a peripheral portion of the flange shaft 155 is positioned so as to be spaced rearwardly from both the cylinder block 400 and the rear crank shaft cap 220. Thus a space is defined between the peripheral portion of the flange shaft 155 and the rearmost crank shaft support portion 470 and the rearmost crank shaft cap 220. The space prevents the flange shaft 155 from coming in contact with the rearmost crank shaft support portion 470 and the rearmost crank shaft cap 220, even when a thrust load is applied to the crank shaft 155.

The annular projection 421 of the oil seal retainer 420 has a larger inner diameter than the outer diameter of the flange shaft 155, so that an outer peripheral surface 156 of the flange shaft 155 is spaced from an inner surface of the annular projection 421. In a similar manner, an inner surface of the oil seal retainer 223 adjacent crank shaft cap 220 is spaced from the outer peripheral surface 156 of the flange shaft 155.

A rear oil seal ring 240 is located between the step portion 422 of the oil seal retainer 420 and the outer peripheral surface 156 of the flange shaft 155. The rear oil seal ring 240 has a "C" cross-sectional shape. An inner portion of the rear oil seal ring 240 is in contact with the outer peripheral surface 156 of the flange shaft 155 and an outer portion of the rear oil seal ring 240 is in contact with the step portion 422 of the oil seal retainer 420 and the inner surface of the crank shaft cap 220. The opening of the "C" of the cross-sectional shape is directed toward the front of the internal combustion engine 1.

A rear end chamber or cavity 260 is defined by the flange shaft 155, the rear oil seal ring 240, the oil seal retainer 420, the rearmost crank shaft cap 220 and associated oil seal retainer 223, and the rearmost crank shaft support portion 470 of the cylinder block 400.

Figure 3:
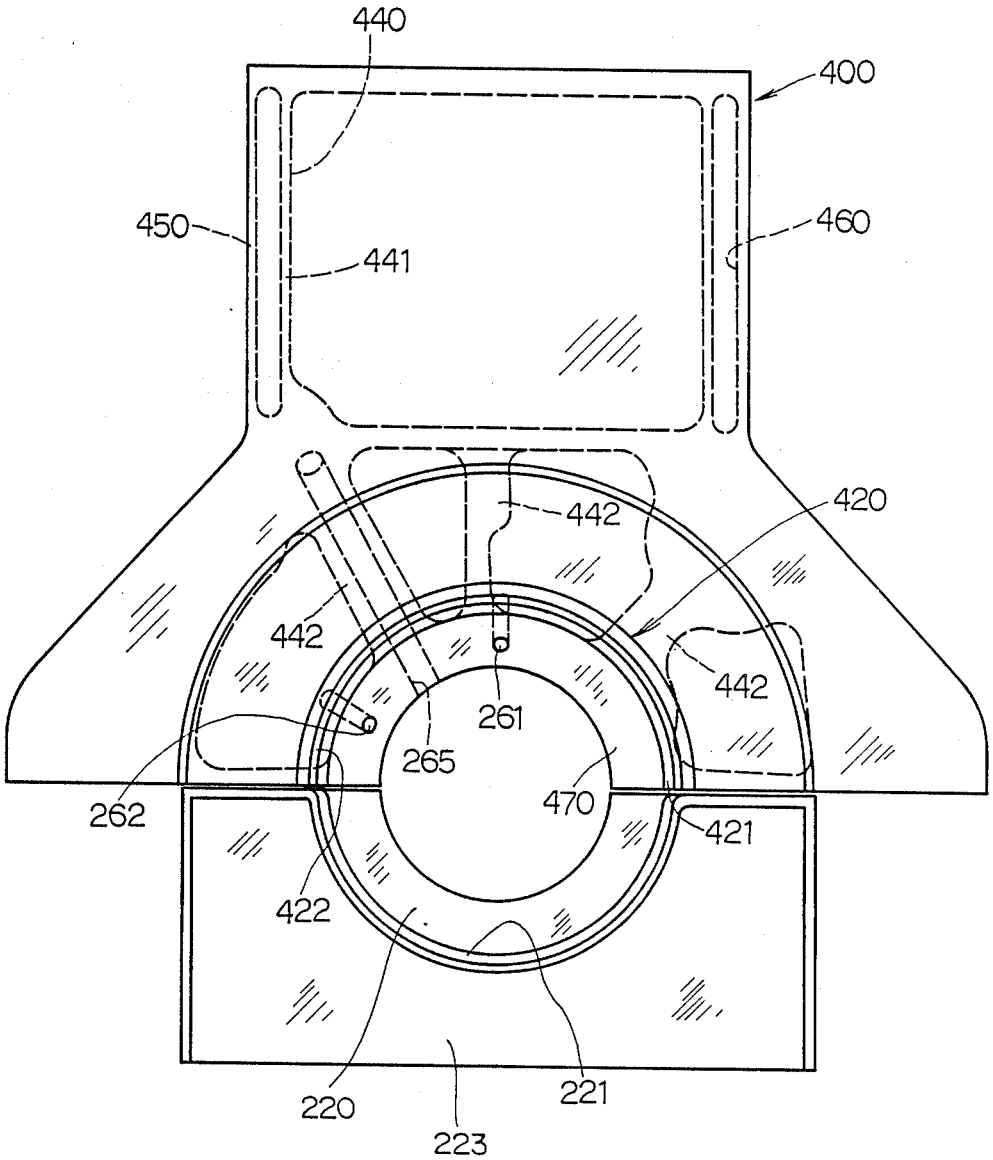
FIG. 3 is a rear view of a cylinder block and a crank shaft cap of the internal combustion engine according to the present invention.

Further, as shown in FIGS. 2 and 3, a plurality of upper conduits 261 and 262 are defined within the cylinder block 400. The upper conduits 261 and 262 connect the rear end chamber or cavity 260 with the crank case 270. Also, a second of lower passage 221 is defined between the crank shaft cap 220 and the oil seal retainer 223. The lower passage 221 also connects the rear end chamber or cavity 260 with the crank case 270.

Therefore, the rear end chamber or cavity 260 is in communication with the crank case 270 through the upper conduits 261, 262 and 221 lower passage, so that the blow-by gas is not trapped within the rear end chamber or cavity 260.

Further, since the blow-by gas passes through the lowerpassage 221, the rear end chamber 260 and the upper conduits 261 and 262, the rear oil seal ring 240 is cooled by the passing blow-by gas. As a result, the durability of the rear oil seal ring 240 is increased.

Therefore, even if the blow-by gas includes a large amount of water, the outer peripheral surface 156 of the flange shaft 155 will not rust. Thus, there is no detraction in the sealing effect of the rear oil seal ring 240 between the outer peripheral surface 156 of the flange shaft 155 and the step portion 422 of the oil seal retainer 420 or the oil seal retainer 223 of crank shaft cap 220.

As shown in FIG. 3, the cylinder block 400 includes an oil passage 265 through which lubricating oil is supplied to the rearmost main bearing insert 230. The crank shaft cap 220 includes the plurality of lower conduits 221 and 222, so that even if lubricating oil leaks into the rear end chamber 260, the lubricating oil flows out from the rear end chamber 260 through the lower conduits 221 and 222. As a result, lubricating oil does not leak from the cylinder block 400.

Further, as shown in FIG. 3, a plurality of ribs 442 bridge the crank shaft support portion 420 and the cylinder wall 441. The rear end chamber 260 may include only one conduit 261 which connects the rear end chamber 260 with the crank chamber 270. In a similar manner, a front end chamber may be in communication with the crank case 270 through a conduit.

Figure 4:
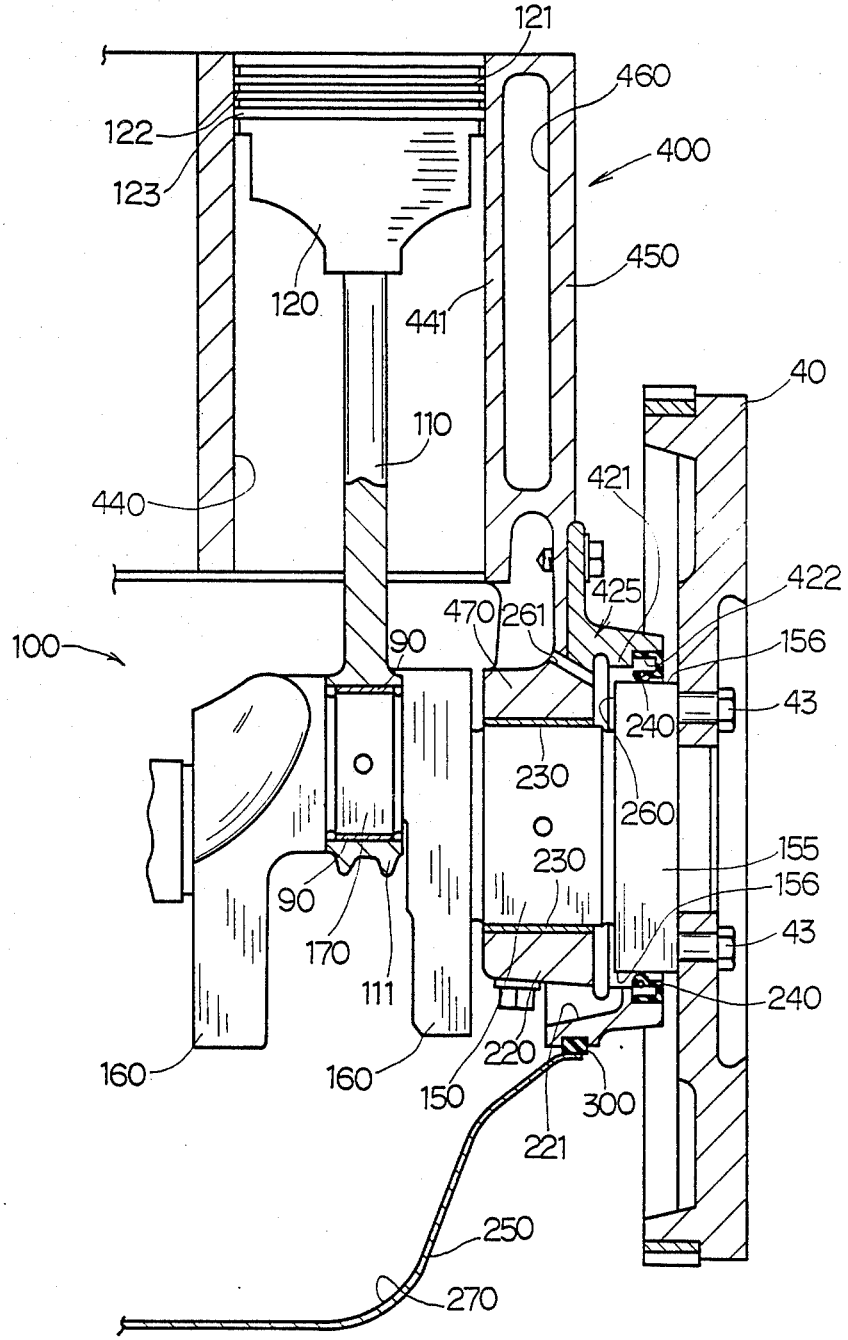
FIG. 4 is an enlarged cross-sectional view of a rear seal ring according to a second embodiment of the present invention.

FIG. 4 shows a second embodiment of an internal combustion engine which is substantially similar to the first embodiment. An oil seal retainer 425 is formed separately from a cylinder block 400 and is secured to the cylinder block 400 by a bolt.

Further, a part of each of a plurality of upper conduits 261 and 262 are formed between the oil seal retainer 425 and the crank shaft support portion 470 of the cylinder block 400.

Figure 5:
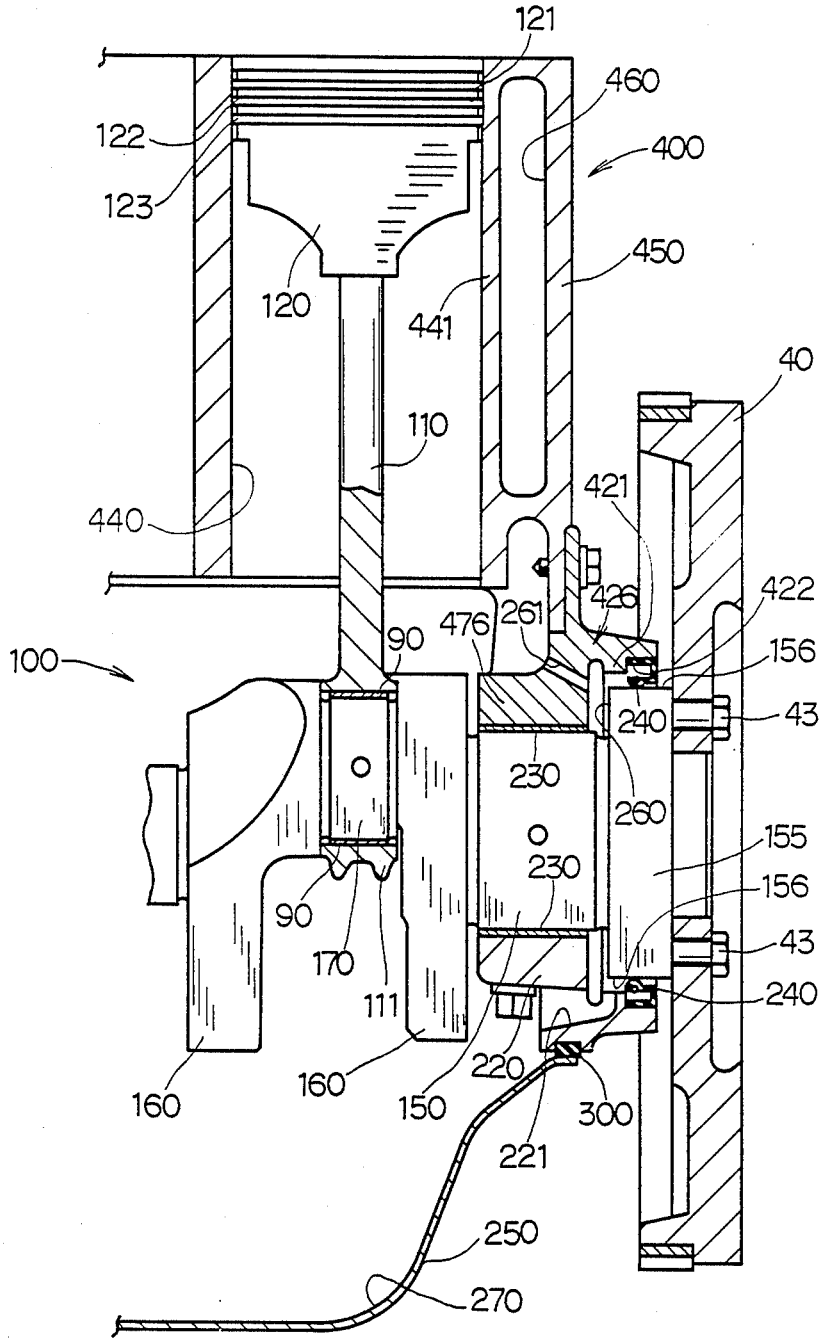
FIG. 5 is an enlarged cross-sectional view of a rear seal ring according to a third embodiment of the present invention.

FIG. 5 shows a third embodiment of an internal combustion engine which is similar to the first and second embodiment. An oil seal retainer 426 and a crank shaft support member 476 are formed separately from a cylinder block 400. The oil seal retainer 426 is formed integrally with the crank shaft support member 476.

The oil seal retainer 426 and the crank shaft support member 476 are secured to the cylinder block 400 by a bolt. Further, a plurality of upper conduits 261 and 262 are formed within the oil seal retainer 426 and the crank shaft support member 476.

As described herein, the present invention overcomes the shortcomings of the known art by providing at least one connecting passage between a rear end chamber and a crank case.

While the present invention has been described in its preferred embodiments, it is to be understood that the invention is not limited thereto, and may be otherwise embodied within the scope of the following claims.

What is claimed is:

1. An internal combustion engine comprising:

a cylinder block including a plurality of cylinders, a crank shaft support portion and a first oil seal retainer portion, the crank shaft support portion being located under the plurality of cylinders, the first oil seal retainer portion projecting outwardly from the cylinder block, a first and second portion of a crank case being defined within the cylinder block;

a cap member secured to the crank shaft support portion of the cylinder block, an opening being defined between the cap member and the crank shaft support portion;

a crank shaft including a journal and a flange portion, the journal being inserted into said opening defined between the crank shaft support portion and the cap member, said crank shaft being mounted rotatably on both the cylinder block and the cap member, the flange portion extending outwardly from the journal, the flange portion having an outer peripheral surface, the flange portion being spaced from the crank shaft support portion and the oil seal retainer portion of the cylinder block, the first portion of the crank case being defined at one side of the crank shaft, the second portion of the crank case being defined at the other side of the crank shaft;

a seal means located between the first oil seal retainer portion and the outer peripheral surface of the flange portion;

a chamber being defined between the flange portion of the crank shaft, the oil seal retainer portion and the crank shaft support portion of the cylinder block, the cap member and the seal means;

a first connecting passage located between the crank shaft support portion and the oil seal retainer portion, the first connecting passage being in connection with the chamber and the first portion of the crank case; and a second connecting passage being defined between a second oil seal retainer portion and the cap member, the second connecting passage being in communication with the chamber and the other portion of the crank case, whereby the chamber is in communication with at least two portions of the crank case through the first and second connecting passages.

2. An internal combustion engine comprising:

a cylinder block including a plurality of cylinders, a crank shaft support portion and an oil seal retainer portion, the crank shaft portion being located under the plurality of cylinders, the oil seal retainer portion projecting outwardly from the cylinder block, a crank case being defined within the cylinder block;

a cap member being secured to the crank shaft support portion of the cylinder block, an opening being defined between the cap member and crank shaft support portion of the cylinder block;

a crank shaft including a journal and a flange portion, the journal being inserted into the opening defined between the crank shaft support portion of the cylinder block and the cap member, said crank shaft being mounted rotatably in the opening on both the cylinder block and the cap member, the flange portion extending outwardly from the journal, the flange portion having an outer peripheral surface, the flange portion being spaced from the crank shaft support portion and the oil seal retainer portion of the cylinder block such that a cavity is defined between the flange portion of said crank shaft, the oil seal retainer portion of said cylinder block, the crank shaft support portion and the cap member;

a seal means located between the oil seal retainer portion of the cylinder block and the outer peripheral surface of the flange portion;

a first connecting passage defined between the crank shaft support portion and the oil seal retainer portion of the cylinder block, the first connecting passage being in communication with the cavity and a first portion of the crank case, whereby the cavity communicates with the first portion of the crank case through the first connection passage; and a second connecting passage defined between the cap member and the flange portion of said crank shaft, the second connecting passage being in communication with the cavity and a second portion of the crank case, whereby the cavity communicates with the second portion of the crank case through the second connecting passage, so that the cavity is in communication with the first and second portions of the crank case through the first and second connecting passages.

3. The internal combustion engine of claim 2, wherein the oil seal retainer and the crank shaft support portion form an integral portion, said integral portion being formed separately from the cylinder block, said integral portion being secured to the cylinder block.

4. The internal combustion engine of claim 2, wherein said first connecting passage includes a first part and a second part, said first connecting passage being connected to the cavity and the first portion of the crank case, whereby the cavity is in communication with at least two portions of the crank case through the first connecting passage and the second connecting passage.

5. An internal combustion engine of claim 4, wherein the oil seal retainer is formed separately from the cylinder block and secured to the cylinder block.

6. The internal combustion engine of claim 5, wherein said second part of the second connecting passage is formed between the oil seal retainer and the crank shaft support portion of the cylinder block.

7. An internal combustion engine comprising:

a cylinder block including a plurality of cylinders, a crank shaft support portion and an oil seal retainer portion, the oil seal retainer portion projecting outwardly from the cylinder block, a crank case being defined within the cylinder block, the crank case including an upper portion and a lower portion;

a cap member being secured to the crank shaft support portion of the cylinder block, an opening being defined between the cap member and the crank shaft support portion of the cylinder block;

a crank shaft including a journal and a flange portion, the journal being positioned in said opening defined between the crank shaft support portion of the cylinder block and the cap member so that the crank shaft is rotatably mounted on both the cylinder block and the cap member, the flange portion extending outwardly from the journal, the flange portion having an outer peripheral surface thereon, the flange portion being spaced from the crank shaft support portion and the oil seal retainer portion of the cylinder block, the upper portion of the crank case being defined between the cylinder block and the crank shaft, the lower portion of the crank case being defined between the crank shaft and an oil pan;

a seal means being positioned between the oil seal retainer portion of the cylinder block and the upper peripheral surface of the flange portion;

a cavity being defined between the flange portion of the crank shaft, the oil seal retainer portion and the crank shaft support portion of the cylinder block, the cap member and the seal means;

a first connecting passage being defined between the crank shaft support portion and the oil seal retainer portion, the first connecting passage being in communication with the upper portion of the crank case and the cavity; and a second connecting passage being defined between the flange portion of the crank shaft and the cap member, the second connecting passage being in communication with the cavity and the lower portion of the crank case, whereby the cavity is in communication with the upper and lower portions of the crank case through said first and second connecting passages.

8. The internal combustion engine of claim 7, wherein the oil seal retainer and the crank shaft support portion form an integral portion, said integral portion being formed separately from the cylinder block, said integral portion being secured to the cylinder block.

9. The internal combustion engine of claim 7, wherein a first connecting passage of the plurality of connecting passages is defined within the crank shaft support portion and a second connecting passage of the plurality of connection passages is defined within the cap member.

10. The internal combustion engine of claim 9, wherein a third connecting passage is defined within the crank shaft support portion.

11. The internal combustion engine of claim 10, wherein the oil seal retainer is formed separately from the cylinder block and secured to the cylinder block.

12. The internal combustion engine of claim 11, wherein each of the first and third connecting passages include a first part and a second part, said first part of said first and third connecting passages being formed between the oil seal retainer and the crank shaft support portion of the cylinder block.

* * * * *